United States Patent [19]

Murphy

[11] Patent Number: 5,069,577

[45] Date of Patent: Dec. 3, 1991

[54] FLEXIBLE RAISED PAVEMENT MARKER

[76] Inventor: Patrick E. Murphy, 933 Dufferin Ave., London, Ontario, Canada, N5W 3K3

[21] Appl. No.: 601,872

[22] Filed: Oct. 23, 1990

[51] Int. Cl.[5] ..... E01F 9/06

[52] U.S. Cl. ..... 404/11; 404/13

[58] Field of Search ..... 404/10, 11, 12, 13, 404/14

[56] References Cited

U.S. PATENT DOCUMENTS

| | | | |
|---|---|---|---|
| 2,224,937 | 12/1940 | Stedman . | |
| 2,328,407 | 8/1943 | Becker . | |
| 2,434,103 | 1/1948 | Elliott . | |
| 2,635,513 | 4/1953 | Batterson . | |
| 3,216,335 | 11/1965 | Stolarczyck et al. . | |
| 3,377,930 | 4/1968 | Kone . | |
| 3,485,148 | 12/1969 | Heenan | 404/12 |
| 3,885,246 | 5/1975 | Tung | 2/3 R |
| 3,890,054 | 6/1975 | O'Conner | 404/10 |
| 3,920,348 | 11/1975 | Paulos | 404/72 |
| 3,963,362 | 6/1976 | Hollis | 404/10 |
| 3,971,623 | 7/1976 | Hedgewick et al. | 350/103 |
| 3,975,108 | 8/1976 | Suhr et al. | 404/16 |
| 4,234,264 | 11/1980 | Baldi | 404/11 |
| 4,297,051 | 10/1981 | Robinson | 404/11 |
| 4,349,598 | 9/1982 | White | 428/161 |
| 4,597,691 | 7/1986 | Clarke | 404/11 |
| 4,747,981 | 5/1988 | Robinsin | 264/1.9 |
| 4,854,768 | 8/1989 | Flanagan et al. | 404/11 |
| 4,895,428 | 1/1990 | Nelson | 350/103 |

OTHER PUBLICATIONS

Wong, S. et al., "Structure-Property Relationships of Transparent Aliphatic Polyurethane Elastomers from the Geometric Isomers of Methylene bis (4-Cyclohexy Isocyanate)", in *Advances in Urethane Science and Technology,* ED. Frisch, K. C. and Klempner, D., Polymer Institute of Detroit, 1984 (pp. 77-101).

Okkema, A. Z. et al., "Bulk, Surface and Blood-Containing Properties of Polyether Polyurethanes Modified With Polydimethylsiloxane Macroglycols", Biomaterials, 1989, vol. 10, Jan.

*Primary Examiner*—William P. Neuder

*Attorney, Agent, or Firm*—Gary L. Griswold; Walter N. Kirn; Douglas B. Little

[57] ABSTRACT

Raised pavement marker useful in geographic areas where snow plows are used and comprising hollow base with an open bottom and dome top, characterized by:

A. base cross section being closed curved shape like cylinder;

B. dome having:

1) outer surface which approximates surface of rotation of a sine wave with highest point in middle of dome;

2) dome cross section is thickest near center and thinnest at p eriphery;

3) at least 2 ribs projecting from surface, to protect reflector which may be cube corner reflectror affixed to dome;

C. material of construction which is an elastomer having $T_g$ no greater than −50° C., preferably polyurethane compound containing a lubricating polymer, such as a silicone.

11 Claims, 3 Drawing Sheets

FLEXIBLE RAISED PAVEMENT MARKER

TECHNICAL FIELD

The invention concerns raised pavement markers primarily used to delineate traffic lanes on roads and highways. More particularly, it concerns an improved marker capable of being struck by a snow plow blade without risk of substantial damage to the marker or the blade.

BACKGROUND

Raised pavement markers offer a greater degree of night delineation, wet or dry, than is offered by painted lines and tapes. They are raised up out of the rain on the street, and they are able to present reflective materials at a more advantageous angle to drivers than flat tapes. However, in areas where snow plows are used, they have not found wide acceptance because they either are removed or damaged by the plows or can damage plow blades.

One solution to the problem of designing a durable pavement marker for snow plow areas is presented in U.S. Pat. No. 4,297,051. That patent shows a deformable highway marker comprising a flexible, cylindrical skirt portion for implanting in a road; a dome-shaped top portion integrally molded with the skirt, for extending above the roadway surface; and a reflecting means associated with the top portion. The dome-shaped top is shown to elastically deform downward when traversed by a snow plow blade, recovering its original shape after the blade has passed.

Although the '051 marker represented an advance in the art, there remained difficulties with its design. It lacked desired durability, and it was difficult to reflectorize.

DISCLOSURE OF INVENTION

Substantial efforts have been made to improve upon the basic concept of U.S. Pat. No. 4,297,051, and they have resulted in a raised marker design which is more durable and a better reflector. The invention can be described as a pavement marker comprising a hollow base having an open bottom and a top closed by a dome, which pavement marker is characterized by:

A. said base having a curved cross sectional shape, selected from circular cylinders, elliptical cylinders, and frustoconical shapes;

B. said dome having an outer surface which approximates a surface of rotation of at least a portion of a sine wave, oriented so that the part of said outer surface nearest the periphery of the base rises gradually (i.e., having a slope substantially lower than the part of said surface midway between the periphery and the dome center) to the center of the dome;

C. said dome having a cross section thickness which is greater at the center than its average thickness and thinner at the periphery of the dome than the average thickness;

D. said dome having at least two ribs projecting from its surface; and

E. being made of an elastomer having a glass transition temperature ($T_g$) no greater than $-50°$ C.

The base may be in the shape of a right circular cylinder, an elliptically shaped cylinder, or frustoconical.

The configuration of the dome facilitates the translation of horizontal motion (snow plow blade movement) into vertical deflection of the dome itself. The initial slope presented to the plow is much less abrupt than was the case with the marker of U.S. Pat. No. 4,297,051. The thinned section on the periphery of the dome can act like a live hinge, further serving to reduce force required to deflect the dome downward.

DETAILED DESCRIPTION

Figure 1:
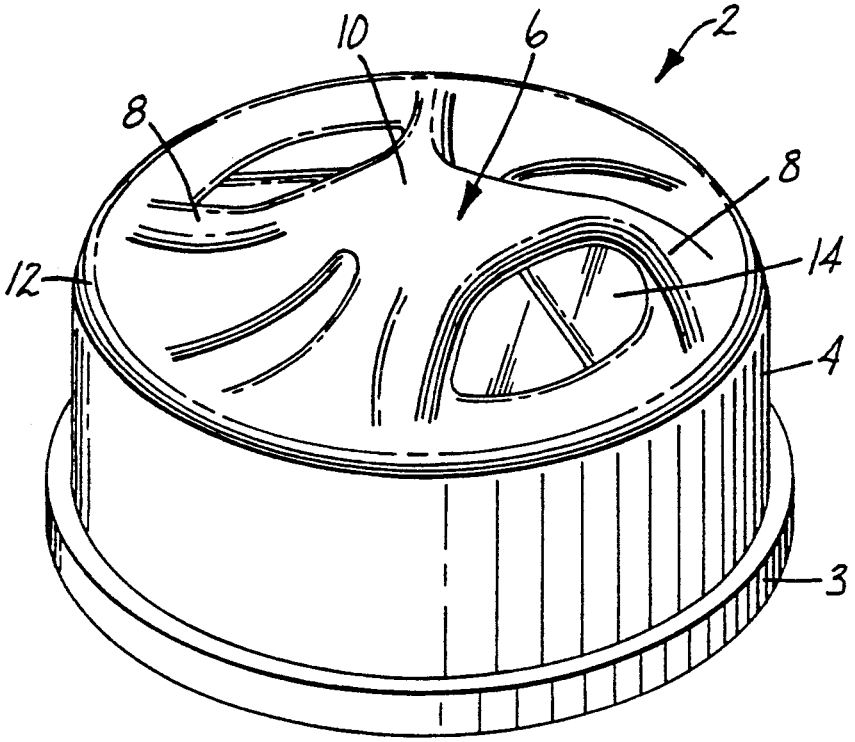
FIG. 1 is a perspective view of a pavement marker within the scope of this invention.
Figure 2:
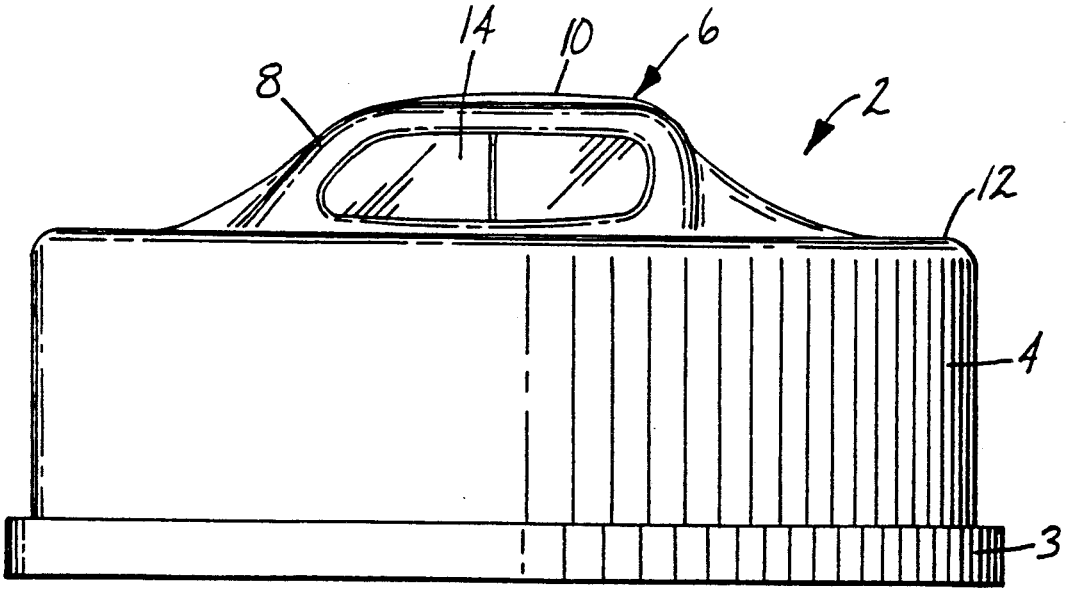
FIG. 2 is an elevation view of the pavement marker of FIG. 1.
Figure 3:
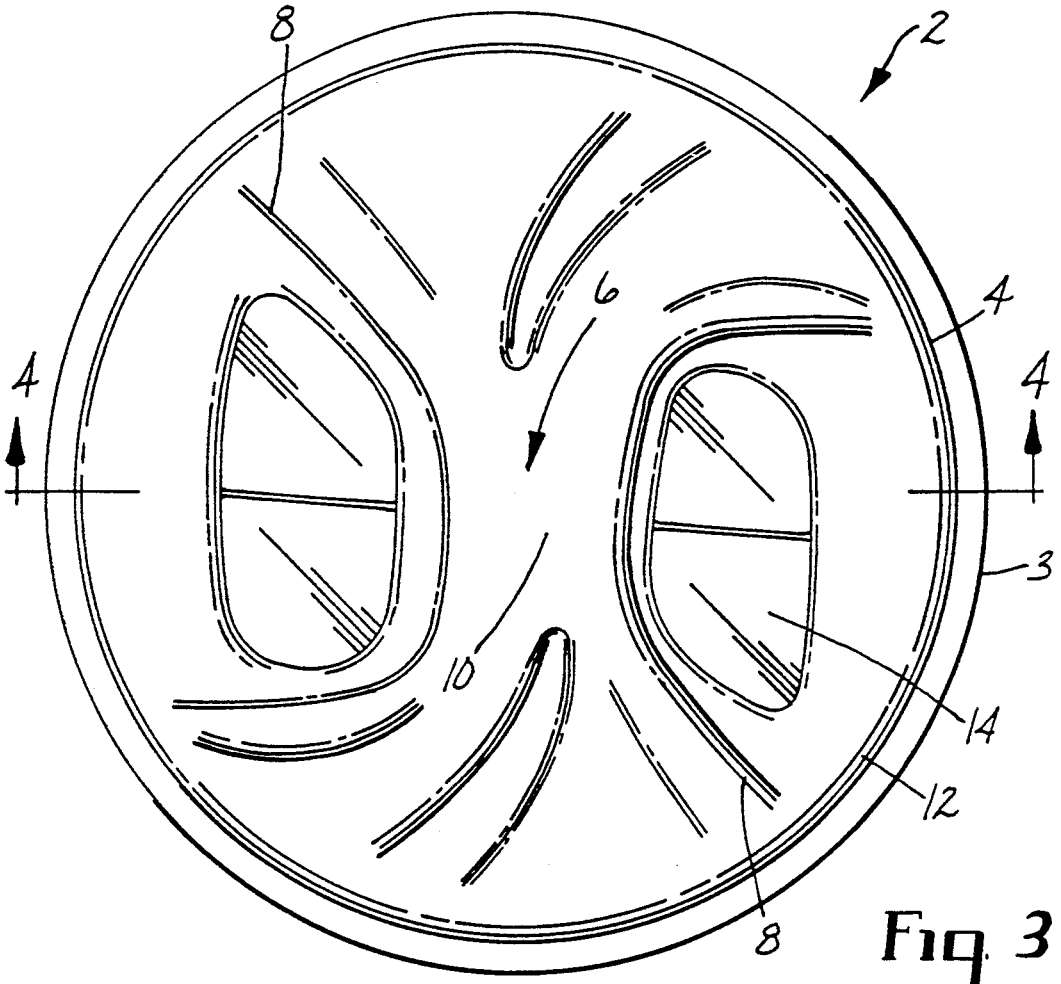
FIG. 3 is a plan view of the pavement marker of FIG. 1.

Snow plows can travel at high speeds (e.g., 50–80 km/hr), imposing rather high strain rates on pavement markers in their path. Therefore, the marker should be designed to resist fracture at such high strain rates and low temperatures (0° to $-30°$ C). Both the marker design and its composition help to accomplish this.

The polymer, and the compound containing said polymer, out of which the inventive pavement marker is made, should be elastomeric and should retain elastomeric properties at the low temperatures likely to be experienced in climates where it snows. Preferably, the $T_g$ of the compound is below $-55°$ C.

Various polyurethane formulations have been used. More specifically, aliphatic polyurethanes have been found useful. Aliphatic polyurethanes are polyurethanes derived from at least one aliphatic polyisocyanate preferably without any aromatic isocyanate. Successful formulations have comprised polytetramethylene oxide (PTMO), a short chain (3–6 carbons) diol such as 1,4 butane diol, and a diisocyanate, such as methylene bis (4-cyclohexyl isocyanate) ($H_{12}MDI$). To such formulations have been added hydroxyl terminated oligomer (such as hydroxyl terminated polybutadiene) and a low molecular weight (1–6C) triol to add advantageous properties. A further useful addition has been a lubricating polymer, such as a silicone (e.g., a polydimethylsiloxane).

Improved properties are found in mixed soft segment polyurethanes containing a hydrophobic component, such as hydroxyl terminated polybutadiene and polydimethylsiloxane. A polymer found particularly useful comprises: 2,000 molecular weight (MW) PTMO; 2,400 MW block copolymer of ethylene oxide (A) and polydimethyl siloxane (B) approximately 50% silicone by weight; 2,800 MW hydroxyl terminated polybutadiene (functionality of 2.4–2.6); 1,4 butane diol; trimethylol propane (TMP); and $H_{12}MDI$ in the respective molar ratios between 0.9/0.1/0.0/1.0/0.03/2.1 and 0.6/0.2/0.2/1.0/0.06/2.1. The sources for these materials were:

PTMO - obtained as Terathane 2000 from E.I. DuPont de Nemours & Co.

Polydimethylsiloxane (PDMS) - obtained as Q4 3667 from Dow Corning Corp.

Hydroxyl terminated polybutadiene (HTPB) - R45 HT from Arco Chemical Co.

1,4 Butanediol - DuPont

TMP - Celanese Chemical Co.

$H_{12}$MDI - Desmodur W from Farbenbabriken Bayer AG

The Q4-3667 PDMS contained small but significant amounts of a unifunctional, polyethylene oxide alcohol. This alcohol might have end-blocked the polyurethane, thus limiting its ultimate molecular weight, adversely affecting its strength. An equal molar equivalence of a triol (trimethylol propane ) was added to the formulation to compensate for the unifunctional species. A very useful proportion of the Q4-3667 PDMS was between 7 and 17 weight percent. Another useful silicone was SF-1188 silicone from General Electric Co, a silicone glycol, ABA block copolymer of polyethylene and propylene oxides (A) and polydimethyl siloxane (B) approximately 50% by weight silicone, nominal MW of 3000.

One preferred polyurethane formulation is:

| | Weight % |
|---|---|
| Terathane PTMO 2000 MW | 62.60 |
| SF-1188 PDMS | 12.96 |
| 1,4 Butanediol | 3.19 |
| Desmodur W $H_{12}$ MDI | 19.30 |
| Tinuvin 292* hindered amine light stabilizer | 1.47 |
| Tinuvin 328* UV light absorber | 0.24 |
| Irganox 245* antioxidant stabilizer | 0.24 |

*from Ciba-Geigy Corp.

Sample films of the above referenced polymer have been prepared by reacting them in the one-shot method at 80° C. and curing to a solid elastomer in a pressure chamber at 620 kPa. All pressures stated in this description are gauge pressures. The proportion of PDMS had a significant effect on durability. Silicone soft segments in the polyurethane tend to decrease tear strength. At 0° C., increasing PDMS level decreased the 100% modulus of the polymer. However, these tendencies were outweighed by other benefits. Silicone results in decreased friction, allowing the pavement marker to slide under a plow blade with less force required. The lower $T_g$ of the silicone helps maintain flexibility under conditions of high strain rate and low temperatures.

The inventive pavement marker can be made from the above described compositions by reaction casting in a heated silicone mold inside a pressure vessel at 620 kPa. The silicone mold can be made from a master sculpted of modeling clay. The clay master for the outer (female) surface of the marker was inserted inside a steel mold box, and degassed silicone was poured into the cavity between the clay master and the mold box. The silicone was cured for 20 hours at room temperature.

The mold for the marker interior surface required the creation of an intermediate female mold to fix the thickness of the marker cross section. A wooden inner mold master was made, and an intermediate mold master of polyester body filler was cast into the cavity between the wooden inner mold master and the mold for the marker outer surface described above. The polyester body filler required filling of pores and voids with putty. Thus, a less porous polymer, such as for example dental impression casting material, would be preferred.

With the intermediate mold in place inside the mold for the outer marker surface, the male inner mold master was cast out of degassed silicone, using a solid aluminum cylinder as a support for the male mold master. The cylinder had several grooves about 3mm wide and 3mm deep about its circumference for the purpose of giving greater surface area onto which the silicone molding compound could bond.

The method of making the marker generally comprises the following steps:

A. making a polymer premix;

B. heating the premix from step A.

C. heating the pavement marker mold;

D. positioning the reflector within the mold (if the reflector is to be integral or molded-in) and adding to the mold the polymer premix;

E. assembling the mold, inserting the inner mold part;

F. placing the mold in a vessel at elevated temperature and pressure and maintaining pressurized conditions long enough to react the polymer to give the molded marker green strength;

G. releasing the pressure, cooling the mold, and removing the pavement marker from the mold; and H. post curing the marker, allowing strength to increase.

In step A, required amounts of polyols, antioxidants and light stabilizers are weighed together into cans. The cans are purged with dry nitrogen, sealed, marked with the formulation code and date, then stored. Polyol cans are placed in a vented convection oven and heated to 80° C. Heated cans are placed, each in turn, on a balance located in a fume hood. Diisocyanate at room temperature is metered into a given polyol can using a calibrated pump dispenser. The $H_{12}$MDI diisocyanate is more hazardous to handle at elevated temperatures, due at least in part to increased vapor pressure and the fact that the process used in developing the inventive pavement marker was an open casting process (i.e., one end of the mold being open to the atmosphere).

Catalyst is then added and the total mixture is stirred until homogeneous. The amount of catalyst employed is important. Insufficient catalyst inhibits the reaction temperative recovery (exotherm) from the quenching effect of using room temperature isocyanate. Low catalyst levels also slow the rate at which markers can be cast. Too much catalyst causes difficulties in mold filling and shortens the time available before the mold must be placed in a pressurized environment to prevent bubble formation. Optimum, catalyst level to balance these effects can be determined by experimentation for each formulation.

In certain work during the development of this invention, 250 grams of the urethane compound described above were poured into the heated outer mold. An aluminum form, bearing the inner (male) mold part was pushed down to a stop at which point the silicone lined mold cavity represents the configuration of the pavement marker. The mold halves were secured into position, and the space between them was topped off (filled) with polyurethane compound. Then the entire assembled mold was placed into the pressure vessel.

The time taken for steps C through F is important because, during this time, a fast reacting polyurethane mixture could form bubbles, ruining the casting. Thus, it is desirable to minimize the time to perform those steps. Minimizing this time allows the use of faster curing mixtures and thus shorter curing cycle times.

The pressure curing in step F is for the purpose of preventing bubble formation in the polymer. Bubbles cease to be a problem once the polyurethane has cured to the point at which it has green strength. Catalyst level is determined at least partly by desired pot life of the premix. Pressure vessel residence time for the mold can be reduced by raising cure temperature. This can be done by means of an electrical heater in or on the vessel. Typical cure temperatures range from 60° to 80° C., and typical pressure cure time was one hour.

In step G, the markers are removed from the molds by first connecting the inner mold to a compressed air line, by means of a small tube through the inner mold. When a small pressure (30–100 kPa) is applied, the silicone inner mold form distorts away from its aluminum core. This action partially releases the mold from the inside of the marker casting.

Post curing (step H.) has comprised placing the markers in a forced air oven at about 80° C. for about 12 hours followed by storing at room temperature for a minimum of one week.

Referring to FIGS. 1–5, a first pavement marker 2 is shown, having base 4, base flange 3, and dome 6. The thicker center portion of the dome is shown as part 10. For a dome having a normal average thickness of about 6 mm, the center should be about 10 mm thick. The ratio of center thickness to average thickness is preferably in the range of 1.3 to 2.0. The increased section thickness at the center of the dome helps reduce deformation of the dome in front of a plow blade like a wave front, which would happen with the constant cross-section thickness domes illustrated in the '051 patent This build-up of dome material in front of the plow blade eventually led to tearing of the dome of the '051 marker. The problem of tearing is exacerbated at very low temperatures (e.g., −15° C.) given the short time allowed for dome deformation and recovery (e.g., 5–10 milliseconds) at usual snow plow speeds. The greater thickness at the center of the inventive marker dome causes the larger strains in the dome to be distant from the cutting edge of a snow plow blade. As a blade passes over the center of the inventive marker, the center section rocks back and slips behind the blade as a unit, causing the build-up of dome material to occur behind the advancing blade. This has been called the toggle action of the marker, for convenience.

The thinner peripheral portion of the dome is shown as part 12. For domes having a nominal average thickness of 6 mm, periphery thickness has been typically 3–4 mm. The ratio of periphery thickness to average dome thickness is preferably in the range of 0.4–0.8, more preferably 0.5–0.7. In an embodiment made during the development of the invention, the periphery of the dome was made thinner by designing it with a radius cut (2–4 mm.) on the underside at the corner where the dome and base meet. Ribs 8, which are integrally molded as part of dome 6, protect reflector 14 from being scuffed by snow plow blades.

Figure 4:
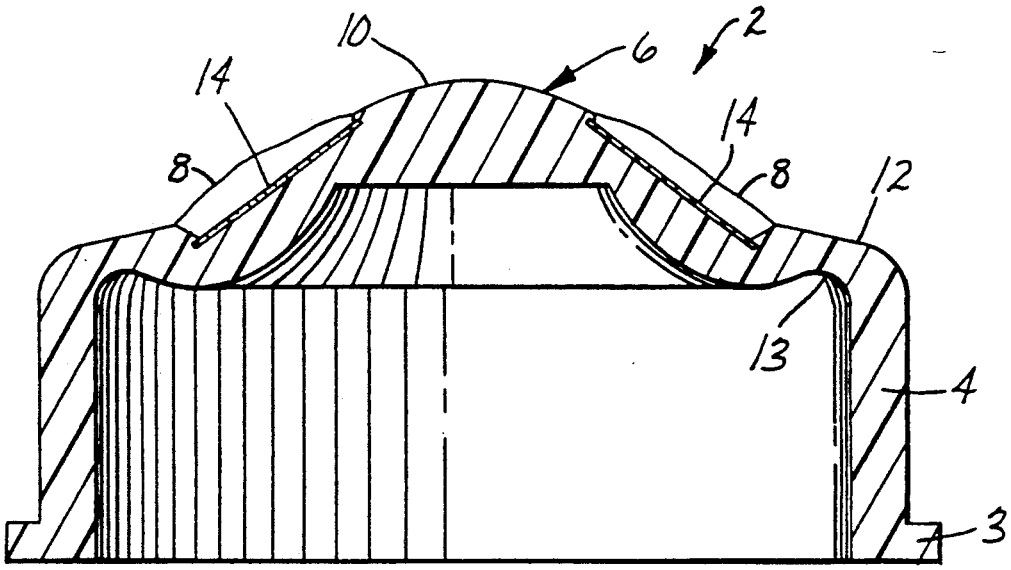
FIG. 4 is a cross sectional view of the pavement marker of FIG. 3 at section line 4—4.

The shape of the dome gives the marker more time to react to the force of a snow plow blade, because of the gradual ramp at the periphery; whereas, the dome of U.S. Pat. No. 4,297,051 presents a discontinuity to the plow blade at the marker periphery (the point where the dome has the maximum stiffness to downward deflection). As noted above, the dome 6 has an outer surface which approximates a surface of rotation of a sine wave. Preferably, the curve of the dome, shown in cross section in FIG. 4, is defined by three sine wave functions, each one for a different section or zone of the curve. The three sine wave functions can be expressed as follows:

$\pi$ radians = radius of marker

S = distance above datum plane or x-axis $\theta$ = distance along datum plane or x-axis (starting from 0 = intersection of base 4 and dome 6)

$\beta$ = marker radius

L = maximum dome height, at center, above x-axis $$A = \frac{4\pi\theta}{\beta}$$

for zone I along x-axis from $\theta = 0$ to $\theta = (\beta/8)$ $$S = \frac{L}{4+\pi}\left(\frac{\pi\theta}{\beta} - \frac{1}{4}\sin A\right)$$

for zone II along x-axis from $\theta = \beta/8$ to $\theta = (7/8)\beta$ $$S = \frac{L}{4+\pi}\left(2 + \left(\frac{\pi\theta}{\beta}\right) - 2.25\sin\left(\frac{\pi}{3} - \frac{A}{3}\right)\right)$$

for zone III $(7/8)\beta \leqq \theta \leqq \beta$ $$S = \frac{L}{4+\pi}\left(4 + \left(\frac{\pi\theta}{\beta}\right) - \frac{1}{4}\sin A\right)$$

Reflector 14 can be a cube corner retroreflector made of flexible, transparent polymeric material, preferably a cube corner retroreflector capable of yielding a minimum of 2.5–3.0 candle power per foot candle of incident light (cp/fc). Preferably, a full aperture cube corner material, as described in U.S. Pat. Nos. 4,895,428 and 4,349,598 is used. Such cube corner material comprises a surface layer and a multiplicity of cube corner prismatic reflecting elements each having a rectangular base on the back side of the surface layer, two mutually perpendicular rectangular faces meeting said base at angles (which may be 45°) and two triangular faces at either end of the prism shape at least one of which triangular faces is perpendicular to said rectangular faces and which, together with said rectangular faces, defines a cube corner therebetween. The back side of the surface layer and the cube corner reflector in general is the side opposite the side intended to face incident light (front side).

The reflector should be sealed on its back side (the side facing toward the marker dome) typically by means of a sealing film (e.g., thermoplastic polyurethane) bonded (heat sealed) to the cube corner reflector. The bonding or sealing is done in a way which preserves an air space or a plurality of air spaces or cells between the sealing film and the back of the cube corner reflector. The air interface with the backs of the cube corners maintains the desirable optics of the reflector for efficient reflection, and the concept is well known in the art. The sealing film does not flow into the air space behind the cube corners because the molding temperature of step F is less than the polyurethane melting temperature.

In one embodiment made during the development of this invention, a cube corner reflective lens about 9.7 $cm^2$ was used in a marker of FIG. 1. Because of its angle to the horizontal, it yielded an actual projected area, straight on, of about 4.8 $cm^2$. The thickness of the dome underneath reflector 14 is preferably adjusted to reduce reflector buckling and damage.

Figure 5:
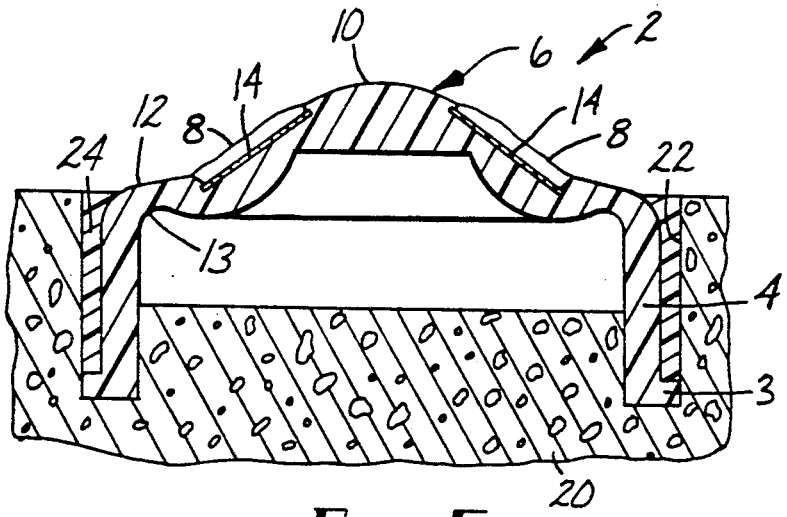
FIG. 5 is a cross sectional view of an installation of the pavement marker of FIG. 1 on a road.

In FIG. 5, the pavement is indicated as 20, the hole into which the pavement marker is installed is designated 22, and the filler in between base 4 and pavement 20 is shown as 24. Preferably, the height of the marker base 4 is less than the depth of the first layer of pavement material on the road.

Figure 7:
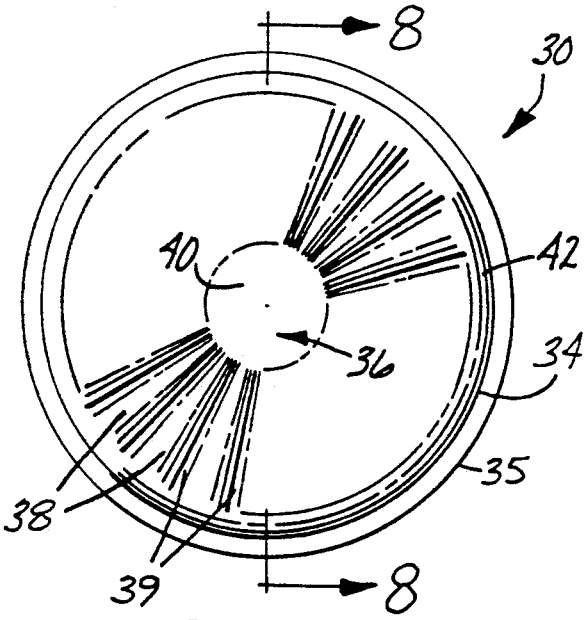
FIG. 7 is a plan view of the pavement marker of FIG. 6.
Figure 8:
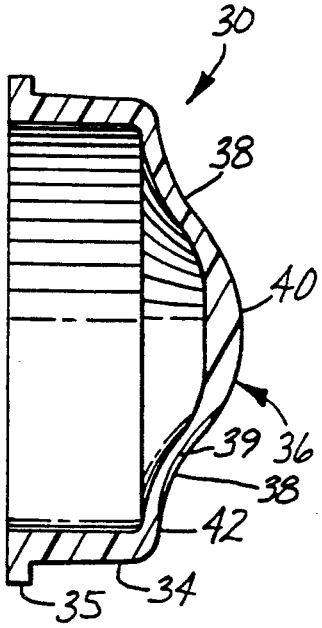
FIG. 8 is a cross sectional view of the pavement marker of FIG. 7, along section line 8—8.
Figure 6:
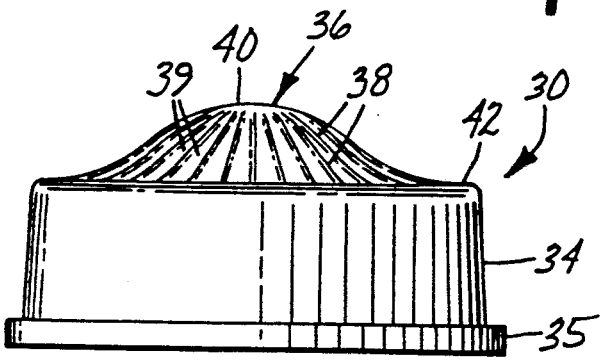
FIG. 6 is an elevation view of a second embodiment of ,the inventive pavement marker.

A second embodiment 30 of the inventive pavement marker is shown in FIGS. 6–8. It is similar to the first marker in that it has base 34, base flange 35, dome 36, thick top portion 40 and thin peripheral portion 42. However, it has a plurality of ribs 38 on the dome and a plurality of depressions 39 in between said ribs. Typically, there are from 24 to 35 such ribs on the dome, preferably fewer so that the depressions can be wider in order to accommodate more retroreflective material This second embodiment is reflectorized by a coating of small retroreflective spherical lenses in said depressions. The layer comprises a multiplicity of such lenses (e.g., glass microspheres) partially embedded in a binder (e.g., polyurethane). Preferably, there is a specular reflector behind the spherical lenses, e.g., a coating of aluminum on the part of the microspheres embedded in the binder. Such a coating can be obtained by coating all the spherical lenses, and removing the aluminum reflective coating from the exposed parts after the binder has been cured, for example by means of an etchant. A method for obtaining a layer of reflectorized microspheres is taught in U.S. Pat. No. 3,885,246, Column 3, lines 1–25.

Also, the surface of the depressions can be given a roughened or stippled surface. This can be done by stippling the surface of the clay master from which the pavement marker mold is cast, for example by applying the ends of a stiff brush to the depression areas while the clay is still in a plastic state.

The binder for the spherical lenses can be an aerosol spray which adheres well to both the polyurethane dome and the lenses themselves. One composition for such a binder is:

| | Parts by Weight (pbw) | Weight % |
|---|---|---|
| Tetrahydrofuran | 100.0 | 44.3 |
| Toluene | 95.9 | 42.5 |
| Cyclohexanone | 20.8 | 9.2 |
| Estane 5712 polyurethane* | 5.6 | 2.5 |
| VAGH resin** | 3.5 | 1.5 |

*from B. F. Goodrich Company
**terpolymer believed to comprise the following monomers: vinyl chloride (90.–92%), vinyl acetate (3%), and vinyl alcohol (5–7%) from Union Carbide Corp.

To 100 pbw of the above adhesive binder are added 50 pbw of aluminum or silver coated, high refractive index (e.g.,1.9 or 2.26) glass microspheres (40–200 micrometers particle size). A layer of binder is applied (sprayed) onto the to the dome of the marker of FIGS. 6–8 and allowed to partly dry until tacky. This layer should be thick enough, when dry, to anchor the microsphere lenses up to their equators. The mixture of microspheres and binder is applied (poured) over the tacky pavement marker surface, and the excesses is tapped off. Heat is applied to cause the microspheres to sink into the binder and drive off solvent. The exposed microsphere surfaces are etched with an acid/dichromate solution (solvent for the silver or aluminum coating), rinsed and dried to yield properly oriented lenses.

The retroreflective intensity of the inventive pavement markers, having a retroreflective coating of spherical lenses, has been measured at 0.677 candela/foot candle of incident light (0.063 candela/lux) and a retroreflectivity coefficient of about 50 candela/lux-/square meter (cd/lx/$m^2$). This compares favorably to the 0.15 cd/fc (0.014 cd/lx) and 0.566 cd/lx/$m^2$ measured on previously known embodiments of the marker of U.S. Pat. No. 4,297,051. These measurements were made at the following conditions: entrance angle=86°, observation angle =0.2°, rotation angle =0°, and presentation angle =0°.

The inventive markers are installed in holes drilled in pavement, typically by a core drill. Preferably, it is a truck mounted, air flushed drill driven by a power take off from the truck. Drilling time for one marker is about 20 seconds to one minute for a hole 45 mm deep.

The annulus between the base and the pavement is filled with a grout or sealant. One useful sealant is an asphalt extended polyurethane The polyurethane comprises a two part system employing a pre-polymer having an excess of isocyanate and a catalyzed (dibutyl tin dilaureate) hydroxyl terminated polybutadiene. The two parts can be extruded through a static mixer from a two-part cartridge gun. One sealant found useful is LC-7241 Detector Loop Sealant from Minnesota Mining and Manufacturing Company, Canada, Inc., London, Ontario, Canada. A solution of dibutyl tin dilaureate catalyst in toluene can be sprayed on the sealant after it has been poured into the annulus to hasten the formation of a protective surface skin.

The inventive pavement markers have been tested in a machine which simulates the action of a snow plow blade scraping cold pavement. Markers, grouted into concrete blocks, are cooled to temperatures of 0° to −30° C. then secured into the test fixture of the machine. The test involves accelerating a plow blade segment to speed, and directing it to strike the marker dome. A clearance of less than 0.5 mm is maintained between the top of the concrete block and the blade edge.

What is claimed is:

1. A pavement marker comprising a hollow base having an open bottom and a top closed by a dome having a center, which pavement marker is characterized by:

A. said base having a curved cross sectional shape, selected from circular cylinders, elliptical cylinders, and frustoconical shapes;

B. said dome having:

(2) an outer surface which approximates a surface of rotation of at least a portion of a sine wave oriented so that the part of said outer surface nearest the periphery of the base has a slope substantially lower than the part of said surface midway between the periphery and the dome center;

(2) a cross section thickness which is greater at the center than its average thickness and thinner at the periphery of the dome than the average thickness;

(3) at least two ribs projecting from its surface; and

C. a material of construction which is an elastomer having a glass transition temperature no greater than −50° C.

2. The pavement marker of claim 1 having a cross section wherein the corner at which the dome and base meet has an interior surface which has been curved toward the outer surface of the marker to make the cross section at said corner thinner than the average cross section thickness of the dome.

3. The pavement marker of claim 1 wherein the elastomer is an aliphatic polyurethane.

4. The pavement marker of claim 1 wherein the elastomer is a polyurethane comprising polytetramethylene oxide, a short chain diol having 3–6 carbons, and a diisocyanate.

5. The pavement marker of claim 4 wherein the diisocyanate is methylene bis (4-cyclohexyl isocyanate).

6. The pavement marker of claim 4 wherein the polyurethane further comprises a polysiloxane.

7. The pavement marker of claim 2 which further comprises at least one retroreflector in between two of said ribs.

8. The pavement marker of claim 7 wherein the retroreflector is a flexible cube corner retroreflector, having a back side facing away from the side intended to face incident light, which is sealed on the back side and attached to the dome, and the ribs are curved and located to protect the retroreflector from impact.

9. The pavement marker of claim 8 wherein the flexible cube corner retroreflector comprises a surface layer and a multiplicity of cube corner prismatic reflecting elements each having: a rectangular base on the back side of the surface layer, two mutually perpendicular rectangular faces intersecting said base and two triangular faces at least one of which is perpendicular to both of said rectangular faces and which, together with said rectangular faces, defines a cube corner therebetween.

10. The pavement marker of claim 7 having a plurality of radially extending ribs having radial depressions between said ribs and wherein said retroreflector comprises a coating of spherical lens elements in said depressions.

11. The pavement marker of claim 1 wherein the ratio of the dome cross section thickness at the dome center to the average dome cross section thickness is 1.3–2.0, and the ratio of the dome cross section thickness at the dome periphery to the average dome cross section thickness is 0.4–0.8.

* * * * *

UNITED STATES PATENT AND TRADEMARK OFFICE

CERTIFICATE OF CORRECTION

PATENT NO. : 5,069,577

DATED : December 3, 1991

INVENTOR(S) : Patrick E. Murphy

It is certified that error appears in the above-indentified patent and that said Letters Patent is hereby corrected as shown below:

On the Title page, item [73], inventor, insert "Assignee: Minnesota Minning and Manufacturing Company, Saint Paul, Minnesota"

Signed and Sealed this

Fifth Day of April, 1994

Bruce Lehman

*Attest:*

BRUCE LEHMAN

*Attesting Officer*

*Commissioner of Patents and Trademarks*